US007634985B2

(12) United States Patent
Parker et al.

(10) Patent No.: US 7,634,985 B2
(45) Date of Patent: Dec. 22, 2009

(54) COMMON RAIL FUEL CONTROL SYSTEM

(75) Inventors: Troy A. Parker, Lafayette, IN (US); James Wallace Harris, Galveston, IN (US); Mitchel Ryan Deckard, Lafayette, IN (US)

(73) Assignee: Caterpillar Inc., Peoria, IL (US)

( * ) Notice: Subject to any disclaimer, the term of this patent is extended or adjusted under 35 U.S.C. 154(b) by 39 days.

(21) Appl. No.: 11/987,355

(22) Filed: Nov. 29, 2007

(65) Prior Publication Data

US 2009/0143958 A1 Jun. 4, 2009

(51) Int. Cl.
*F02M 69/54* (2006.01)

(52) U.S. Cl. ..... 123/435; 123/457; 123/511

(58) Field of Classification Search ..... 123/447, 123/456–457, 510–511, 435; 73/35.12, 114.38, 73/114.43

See application file for complete search history.

(56) References Cited

U.S. PATENT DOCUMENTS

| | | | | |
|---|---|---|---|---|
| 5,819,704 | A | 10/1998 | Tarr et al. | |
| 6,497,223 | B1 | 12/2002 | Tuken et al. | |
| 6,609,500 | B2 * | 8/2003 | Ricco et al. | 123/446 |
| 6,772,738 | B2 * | 8/2004 | Rembold et al. | 123/514 |
| 6,817,343 | B1 * | 11/2004 | Greco et al. | 123/497 |
| 7,047,938 | B2 | 5/2006 | Flynn et al. | |
| 7,066,149 | B1 | 6/2006 | Date et al. | |
| 7,077,082 | B2 | 7/2006 | Bloms et al. | |
| 7,100,574 | B2 * | 9/2006 | Otani | 123/456 |
| 7,143,747 | B2 | 12/2006 | Uchiyama | |
| 7,201,150 | B2 | 4/2007 | Oono | |
| 7,261,087 | B2 | 8/2007 | Ricco et al. | |
| 7,284,539 | B1 | 10/2007 | Fukasawa | |
| 7,287,515 | B2 | 10/2007 | Okamura et al. | |
| 2001/0009149 | A1 | 7/2001 | Hirata et al. | |
| 2001/0032619 | A1 | 10/2001 | Nishiyama | |
| 2006/0102152 | A1 | 5/2006 | Shinogle et al. | |
| 2006/0225706 | A1 * | 10/2006 | Eser et al. | 123/457 |
| 2007/0079809 | A1 | 4/2007 | Oono | |
| 2007/0144490 | A1 | 6/2007 | Serra et al. | |

* cited by examiner

*Primary Examiner*—Hai H Huynh
(74) *Attorney, Agent, or Firm*—Finnegan, Henderson, Farabow, Garrett & Dunner

(57) ABSTRACT

A method of controlling a common rail fuel system for an engine is disclosed. The method includes delivering fuel to a fuel injector fluidly coupled to a common rail. The common rail is fluidly coupled to a fuel tank through a pump. The method also includes sending a signal to the fuel injector to deliver a first quantity of fuel to the engine. The first quantity being indicative of a desired power from the engine. The method further includes detecting a fuel transfer pressure upstream of the pump, and derating the engine as a function of the detected fuel transfer pressure. The derating includes decreasing the first quantity of fuel.

18 Claims, 3 Drawing Sheets

COMMON RAIL FUEL CONTROL SYSTEM

TECHNICAL FIELD

The present disclosure relates generally to an engine fuel control system, and more particularly to control of a common rail fuel injection system.

BACKGROUND

In order to improve the fuel economy and power density of diesel engines while restricting exhaust emissions to within acceptable levels, fuel systems incorporating direct injection of the fuel into a combustion chamber (that is, the cylinder) of an engine through an injector, were developed. One of these direct injection fuel systems is the common rail fuel system. As high speed direct injection engines developed, energy to mix air with fuel in the cylinder was provided by the fuel spray momentum, as opposed to swirl mechanisms which were employed in the older combustion systems. Good mixing of fuel and air before combustion allows for even temperature distribution in the cylinder (that is, no hot spots), and reduced particulate matter, hydrocarbon and $NO_x$ emissions. To provide the mixing energy needed for low emissions from the engine, High Pressure Common Rail (HPCR) fuel injection systems were employed in diesel engines.

In an HPCR system, fuel is distributed to injectors, coupled to engine cylinders, from an accumulator, called the rail. Fuel from a fuel tank is delivered to the rail by a high pressure pump. The pressure of the fuel in the rail, as well as the start and end of injection in each cylinder (that is, injection rate and timing) are electronically controlled by a control system associated with the engine. In general, fuel pressure in a typical HPCR system does not depend on the engine speed and load conditions, thereby allowing for flexibility in controlling both injection rate and timing. Decoupling fuel pressure from engine speed allows for good fuel mixing even at low engine speeds and loads. In a typical HPCR system, a low pressure lift pump delivers fuel from a fuel tank through one or more fuel filters to the high pressure pump. An actuator operated metering valve controls the amount of fuel entering the high pressure pump. The high pressure pump delivers fuel at a constant pressure via a pressure regulator to the rail. Pressure sensors and temperature sensors installed in the fuel system monitor the temperature and pressure at critical points of the system. An Electronic Control Unit (ECU) may use these pressure and temperature readings, along with other inputs from the engine, to control the rail pressure, timing and duration of injection. The ECU may operate one or both the pressure regulator and the inlet metering valve of the high pressure pump to control the rail pressure. To initiate injection into a cylinder, the ECU may apply an electrical pulse having a variable duration to a control valve of the injector. The control valve may open a throttle in response to the electrical pulse, thereby fluidly coupling the rail to the cylinder. The duration of the electrical pulse may control the amount of time the control valve keeps the throttle open. Thus, the ECU may control the timing and duration of injection by controlling the timing and width of the electrical pulse used to energize the control valve. The pulse duration may determine the amount of fuel delivered to the cylinder. For a fixed pulse duration, the amount of fuel delivered into the cylinder increases with increased rail pressure. The ECU may determine the required amount of fuel to be delivered to the engine based on engine power output requirements. Engine power output requirements may be determined based on inputs such as engine speed, throttle position, etc. The ECU may determine the duration of the electrical pulse to be applied to the control valve based on the required amount of fuel and the rail pressure.

In a typical HPCR system, disruption of fuel flow on the upstream side of the high pressure pump may decrease the rail pressure. The decreased rail pressure may significantly increase the duration of time fuel may be sprayed into the cylinder to meet engine power output requirements. This increased spray time may prolong fuel injection well into the power stroke and decrease the effectiveness of combustion. In some cases, a prolonged fuel spray may also cause the injected fuel to miss the piston bowl and land on the cylinder liner instead. Liner fuel injection may cause reliability issues such as liner scuffing and wear, and detrimentally affect fuel economy and emissions.

U.S. Pat. No. 7,287,515 ('515 patent), a patent to Okamura et al., issued on Oct. 30, 2007, describes an engine fuel control system that modifies the quantity of fuel delivered to the engine based on an operating condition of the engine. The fuel control system of the '515 patent uses an engine controller to calculate a corrected fuel injection quantity based on an estimated rail pressure at a prescribed fuel injection time. The rail pressure is estimated based on a computed rail pressure correction factor. The fuel control system of the '515 patent delivers the corrected fuel injection quantity to a cylinder through an injector to produce a desired engine torque. Although the fuel control system of the '515 patent controls the quantity of fuel delivered to the engine based on the rail pressure, the system may still be susceptible to the previously described issues when the rail pressure is low.

SUMMARY

In one aspect, a method of controlling a common rail fuel system for an engine is disclosed. The method includes delivering fuel to a fuel injector fluidly coupled to a common rail. The common rail is fluidly coupled to a fuel tank through a pump. The method also includes sending a signal to the fuel injector to deliver of a first quantity of fuel to the engine. The first quantity being indicative of a desired power from the engine. The method further includes detecting a fuel transfer pressure upstream of the pump, and derating the engine as a function of the detected fuel transfer pressure. The derating includes decreasing the first quantity of fuel.

In another aspect, a method of derating an engine is disclosed. The method includes delivering fuel to the engine using a common rail fuel system. The common rail fuel system includes at least a pump, a common rail, and a fuel injector fluidly coupled in series to deliver the fuel to the engine. The method also includes using a control system to control an amount of fuel delivered to the engine based on feedback. The feedback includes a desired torque of the engine and a fuel transfer pressure of the fuel system. The desired torque is a measure of a power output desired from the engine and the fuel transfer pressure is indicative of a pressure of the fuel upstream of the pump. The method further includes derating the engine in response to a reduction in the fuel transfer pressure. The derating includes reducing the amount of fuel delivered to the engine to reduce a power produced by the engine to below the desired power output.

In yet another aspect, a method of operating an engine is disclosed. The method includes combusting a fuel in a combustion chamber of the engine to produce power, and injecting fuel to the combustion chamber using a fuel injector. The method also includes directing fuel to the fuel injector through a common rail using a common rail fuel system. The common rail fuel system includes a pump delivering pressurized fuel to the rail. The method also includes controlling a timing and quantity of the injected fuel using a control system, and detecting a fuel transfer pressure of the fuel upstream of the pump. The method further includes decreasing the quantity of injected fuel by an amount in response to a decrease in fuel transfer pressure to a first threshold pressure, and further decreasing the quantity of injected fuel by an amount in response to a further decrease in fuel transfer pressure from the first threshold pressure to a second threshold pressure.

DETAILED DESCRIPTION

Figure 1:
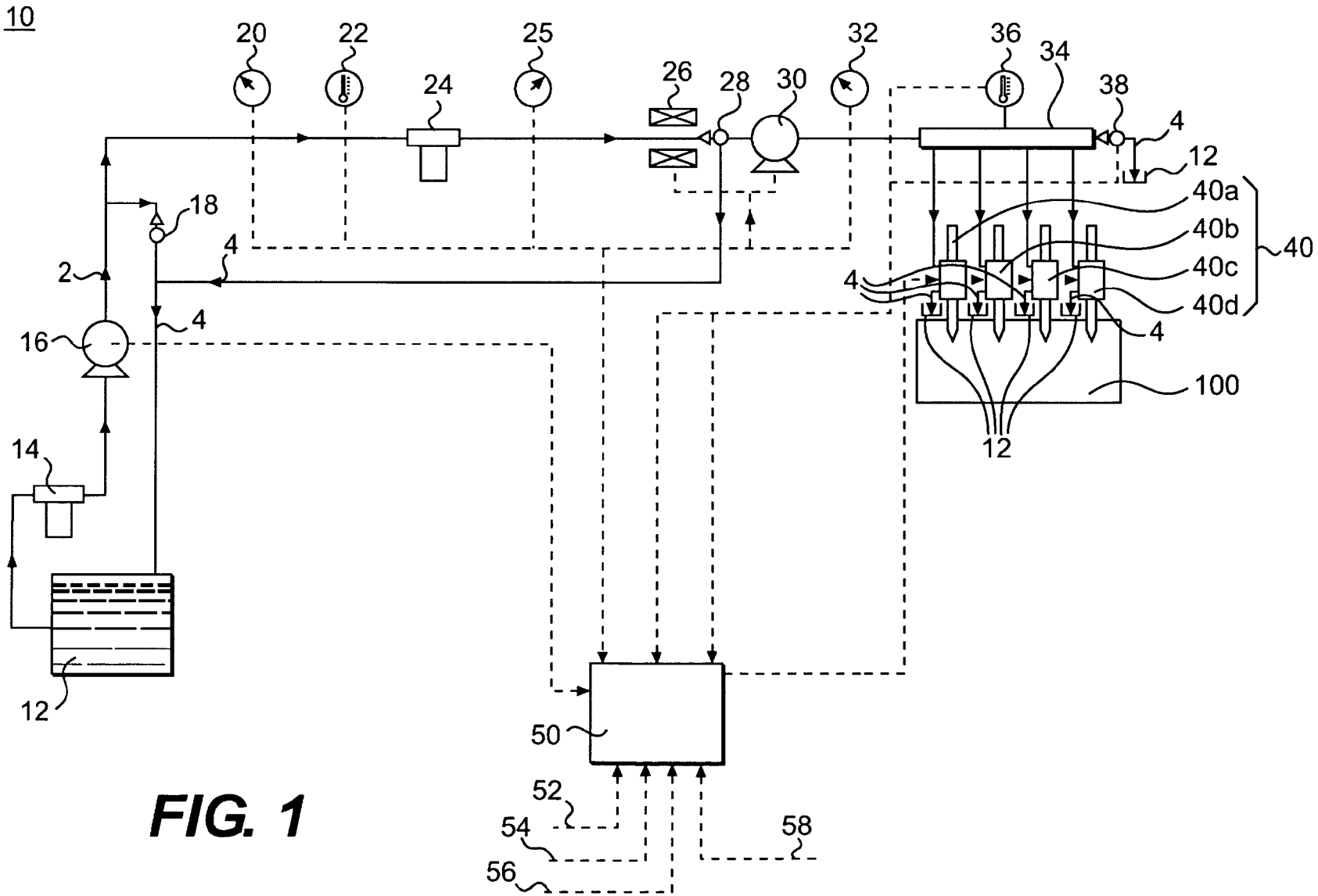
FIG. 1 is a schematic view of an exemplary fuel control system of an engine.

FIG. 1 illustrates an exemplary fuel control system 10 for an engine 100. Fuel control system 10 includes a fuel tank 12 fluidly coupled to engine 100 through one or more fuel injectors 40. In general, the number for fuel injectors 40 in fuel control system 10 may match the number of cylinders in engine 100. Although FIG. 1 illustrates four injectors 40*a*, 40*b*, 40*c*, and 40*d* coupled to four cylinders (not shown) of engine 100, it is contemplated that engine 100 may comprise a different number of cylinders and fuel injectors 40. Fuel tank 12 may include a liquid fuel that may be combusted in engine 100. Although, the type of fuel in fuel tank 12 may depend upon the type of engine 100, in the description that follows, engine 100 is described as a diesel engine and fuel in fuel tank 12 is described as diesel fuel.

A low pressure pump 16 may deliver the fuel from fuel tank 12 to a high pressure pump 30 through a fuel supply passage 2. The low pressure pump 16 may be driven by an electric motor driven by a power source (such as, the battery) of engine 100. Any type of pump used in the art may be used as low pressure pump 16. Although low pressure pump 16 in FIG. 1 is shown to be outside fuel tank 12, in some embodiments, low pressure pump 16 may be located within fuel tank 12.

A first fuel filter 14 and a second fuel filter 24 may also be coupled to fuel supply passage 2 to filter particulates from the fuel. First and second fuel filters 14 and 24 may be any type of fuel filter used in the art. These fuel filters (14 and 24) may include filter media and/or other components to perform their intended tasks. Both first fuel filter 14 and second fuel filter 24 may be the same type of filter, or may be different types. First fuel filter 14 may be located on the upstream side of low pressure pump 14 and second fuel filter 24 may be located on the downstream side thereof.

In order to prevent a discharge pressure of low pressure pump 16 from exceeding a prescribed pressure, a pressure regulator 18 may be coupled to the downstream side of low pressure pump 16. If the discharge pressure exceeds the prescribed pressure, pressure regulator 18 may direct a portion of fuel from fuel supply passage 2 to a return passage 4 to keep the pressure of fuel in fuel supply passage 2 at the prescribed pressure. Return passage 4 may direct the fuel back to fuel tank 12.

A first pressure sensor 20 and a first temperature sensor 22 may be coupled to fuel supply passage 2 to measure a temperature and pressure of the fuel downstream of low pressure pump 16. Any type of pressure and temperature sensor known in the art may be used as first pressure sensor 20 and first temperature sensor 22. A second pressure sensor 25 may also be coupled to fuel supply passage 2 downstream of the second fuel filter 24, to measure fuel pressure downstream of second fuel filter 24. Comparison of readings from first pressure sensor 20 and second pressure sensor 25 may indicate a pressure drop of fuel while flowing through second fuel filter 24. An increased pressure drop may indicate a clogged condition of second fuel filter 24 that may require maintenance.

An actuator 26 operated metering valve 28 coupled to fuel supply passage 2 may control the amount of fuel that enters high pressure pump 30. Actuator 26 may be configured to open and close metering valve 28 in response to instructions from an ECU 50. In some embodiments, in the fully opened position, metering valve 28 may direct all the fuel in fuel supply passage 2 to high pressure pump 30, while in a fully closed position, metering valve 28 may prevent fuel from flowing into high pressure pump 30. In some embodiments, metering valve 28 may redirect fuel from fuel supply passage 2 to return passage 4 when metering valve 28 is in a closed position. ECU 50 may thus control the amount of fuel delivered to high pressure pump 30.

High pressure pump 30 may increase the pressure of fuel passing through it, and deliver fuel at a high pressure to a rail 34. High pressure pump 34 may be driven by engine 100. In some embodiments, high pressure pump 30 may include one or more plungers driven by one or more cams coupled to a crankshaft of engine 100. These plungers may be configured and arranged to reciprocate within cylinders and pressurize the fuel passing therethrough. Any pump known in the art may be used as high pressure pump 30. In some embodiments, high pressure pump 30 may include three plungers arranged in line on separate cam lobes at 120° phasing resulting from the arrangement of the cam lobes. However, it is contemplated that in some embodiments, the plungers may be configured differently. These plungers may be configured to generate multiple filling and pumping strokes per revolution of the cam.

A second temperature sensor 32 and a third pressure sensor 36 may be coupled to the downstream side of high pressure pump 30 to measure the temperature and pressure of fuel delivered to rail 34. A pressure relief valve 38 may also be coupled to rail 34 to control the pressure of fuel in the rail 34 ("rail pressure"). When the rail pressure exceeds a prescribed value, pressure relief valve 38 may open to allow a portion of fuel in rail 34 to return to fuel tank 12 through return passage 4. In some embodiments, pressure relief valve 38 may also be operated by an actuator controlled by ECU 50. Metering valve 28, pressure relief valve 38 and high pressure pump 30 may cooperate to adjust the timing, quantity and pressure of fuel delivered to rail 34.

Rail 34 may serve as a fuel accumulator and may be designed to supply pressurized fuel to injectors 40 without a significant pressure drop. The volume of fuel in rail 34 may assist in damping pressure oscillations caused by high pressure pump 30 and the injection process. From rail 34, the fuel may be supplied at constant pressure to fuel injectors 40 through high pressure pipes. The volume of rail 34 varies depending upon engine 100. The high-pressure fuel in rail 34 may be distributed to fuel injectors 40 coupled to each cylinder of engine 100. Since FIG. 1 illustrates an embodiment in which engine 100 has four cylinders, fuel in common rail 34 may be delivered to fuel injectors 40*a*, 40*b*, 40*c*, 40*d* (collectively "fuel injector 40") respectively, each coupled to an individual cylinder of engine 100. Fuel injectors 40 may include any type of fuel injector that may be used with a diesel engine. For the sake of brevity, only those aspects of an exemplary fuel injector 40 that are relevant to the disclosed fuel control system are described herein.

Fuel injector 40 may include an electro-hydraulic device that incorporates a control valve that activates an injection nozzle. The control valve may be a solenoid or a piezoelectric device that may be configured to open the injection nozzle in response to a signal from ECU 50. The signal from ECU 50 may include an electric pulse having a prescribed duration (or width). Upon receiving the electric pulse from ECU 50, the control valve may open the injection nozzle for the duration of the pulse. That is, the width or duration of the electric pulse from ECU 50 may define the start and the end of each injection event per engine cycle. In some embodiments, ECU 50 may generate more than one injection event for a cylinder per cycle. An open injection nozzle may inject fuel in rail 34 into a combustion chamber of a cylinder, that fuel injector 40 may be coupled to.

Fuel may be injected into the cylinders by opening each fuel injector 40*a*, 40*b*, 40*c*, 40*d* at a prescribed fuel injection timing in accordance with the firing order of engine 100. For example, in an embodiment where fuel injectors 40*a*, 40*b*, 40*c*, and 40*d* are each coupled to a first cylinder, a second cylinder, a third cylinder, and a fourth cylinder respectively, and the firing order of engine 100 is 1-3-4-2, injection nozzle of fuel injector 40*a* may be opened first, followed by injection nozzles of fuel injectors 40*c*, 40*d*, and 40*b* respectively. Further, each injection nozzle may be opened at a prescribed time and for a prescribed duration as determined by ECU 50.

ECU 50 may include hardware and software configured to control the operation of fuel control system 10 based on feedback signals from a number of sensors. In some embodiments, ECU 50 may be combined with a control system (such as, an engine control system) that performs other functions. Sensors electrically connected to ECU 50 may include sensors coupled to the fuel control system (such as, first, second, and third pressure sensors 20, 25, and 36, and first and second temperature sensors 22 and 32), and sensors configured to measure/detect other operating parameters of engine 100. Sensors that measure operating parameters of engine 100 may include crank shaft speed sensor 52, cam shaft position sensor 54, throttle position sensor 56, temperature sensor 58, etc. Based on feedback from these sensors, ECU 50 may control the operation of components of fuel control system 10. For instance, ECU 50 may control the operation of low pressure pump 16, high pressure pump 30, metering valve 28, actuator 26, and control valve of fuel injectors 40, etc. based on feedback from sensors.

The control functions performed by ECU 50 may include, among others, rail pressure control, injection control, speed balancing/torque control, and derate control. Rail pressure may be adjusted by controlling actuator 26 operated metering valve 28 and pressure relief valve 38 in response to a pressure reading of third pressure sensor 36. ECU 50 may compare third pressure sensor 36 reading to a preset value of pressure, and open or close metering valve 28 and/or pressure relief valve 38 to vary rail pressure. This preset value of pressure may be a fixed value or a calculated value based on engine speed and/or other engine operating parameters. In some embodiments, the preset value may be a pressure value determined from a schedule or a map based on one or more engine operating parameters. If rail pressure is below the preset value, metering valve 28 may be opened to increase the amount of fuel delivered to rail 34 and thereby increase rail pressure. If rail pressure is above the preset value, pressure relief valve 38 may be opened to redirect a portion of fuel in rail 34 to fuel tank 12 through return passage 4. Alternatively or additionally, ECU 50 may partially close metering valve 28 to decrease the quantity of fuel delivered to rail 34, and thereby reduce rail pressure.

Fuel injection may be controlled by ECU 50 by varying the timing and duration of the electric pulse applied to fuel injectors 40. In some embodiments, injection may be split into multiple phases such as pilot injection and main injection. Each injection may be defined by a timing (advance angle before Top Dead Center (TDC) of piston in the cylinder) and a fuel quantity delivered per stroke (such as, for example grams/stroke). Timing of injection may be based on the position of piston in a cylinder, that may be indicated by a crank shaft or cam shaft position sensor. For timing control, the advance angle may be converted into a time interval using engine speed. Additional software compensation may also be provided for injector opening and closing delays. ECU 50 may synchronize the start of the electric pulse to fuel injectors 40 to initiate fuel injection at a desired piston location. Fuel quantity calculations may be similar to that in conventional electronic diesel injection systems. ECU 50 may determine the required fuel quantity based on engine operating parameters, such as throttle position and engine speed. Based on this required fuel quantity and rail pressure, ECU 50 may calculate the pulse width to be applied to fuel injectors 40. To deliver a required fuel quantity to a cylinder, pulse width may be higher at low rail pressures than at high rail pressures. In some embodiments, this relation may be recorded as a map, and ECU 50 may determine the pulse width based, at least in part, on this predetermined map.

In some embodiments, ECU 50 may use crank shaft and/or cam shaft sensor signals to calculate net engine torque to perform speed balancing and torque control. A variation between two cylinders may produce an uneven torque and cause rough engine running, particularly at low engine speed and load. ECU 50 may use a crank shaft speed analysis to adjust fuel delivery among fuel injectors 40 in order to balance engine speed.

Derating an engine refers to powering down (reducing the torque output) engine 100 in response to a measured parameter. For instance, engine 100 may be powered down in response to a fault in fuel control system 10. Powering down engine 100 may include reducing the fuel supply delivered to engine 100 to a value sufficient to keep engine 100 running until it can be safely shut down. It is understood that derating may be maintained until the fault condition reaches a predetermined criticality. In cases where the fault condition reaches a predetermined criticality engine 100 cannot operate in a safe condition, and the engine 100 is shut down.

Derating engine 100 may reduce the torque produced by engine 100 to a predetermined percentage of a desired torque. The desired torque may be determined by ECU 50 based on feedback from engine 100, such as feedback from crank shaft speed sensor 52, throttle position sensor 56, etc. The predetermined percentage may depend upon the application. This predetermined percentage value may be stored in ECU 50 or may be calculated by ECU 50 based on other inputs. In some embodiments, the predetermined percentage value may be chosen by ECU 50 based on a map stored therein. This map may specify the percentage of derate to apply as a function of fuel transfer pressure and other variables (such as, throttle position, desired torque, etc.). If in an application, the predetermined percentage of torque reduction is chosen to be 80%, ECU 50 may limit the torque produced by engine 100 to about 20% of the desired torque in response to a fault in fuel control system 10. ECU 50 may keep engine 100 running at 20% of the desired torque until engine 100 is shut down and the fault in fuel control system 10 is rectified. In such an application, ECU 50 may apply a 100% derate on engine 100 to reduce the torque produced by engine 100 to about 20% of the desired torque. That is, applying a 100% derate on engine 100 may reduce the torque produced by engine 100 to about the predetermined percentage chosen by ECU 50. The engine 100 may be operated at this reduced level until engine 100 is shut down and the fault rectified. As noted above, in cases where engine 100 has to shut down in response to the fault condition reaching a predetermined criticality ECU 50 may apply a 100% derate to shut down engine 100.

Derate control may be performed by ECU 50 in response to a detected low fuel transfer pressure. Fuel transfer pressure may be a pressure in fuel supply passage 2 downstream of low pressure pump 16. Fuel pressure readings from first pressure sensor 20 or second pressure sensor 25 may indicate fuel transfer pressure. In some embodiments, fuel transfer pressure may be the lower of the pressure values detected by first pressure sensor 20 and second pressure sensor 25. A low fuel transfer pressure may occur due to a fault in the fuel supply, such as for example, a low fuel level in fuel tank 12, a clogged first fuel filter 14, a clogged second fuel filter 24, faulty low pressure pump 16, or another fault in fuel supply. As a result of a decrease in fuel transfer pressure, the ability of high pressure pump 30 to increase the pressure of the fuel passing therethrough decreases. Therefore, a decrease in fuel transfer pressure may be manifested by a reduction in rail pressure. In response to the decreased rail pressure, ECU 50 may open metering valve 28 to increase rail pressure. In some embodiments, such an opening of metering valve 28 may cause rail pressure to increase beyond a desired value causing ECU 50 to close the metering value 28 to reduce the rail pressure. The repeated opening and closing of metering valve 28 to remedy the rail pressure reduction resulting from a decrease in fuel transfer pressure may cause the rail pressure to be unstable.

Figure 2A:
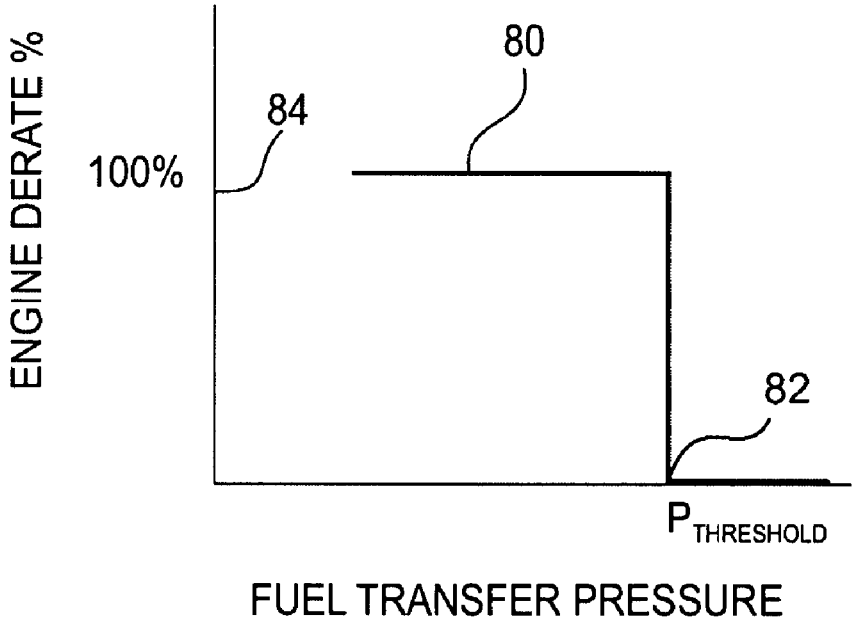
FIGS. 2A-2C illustrate different embodiments of derate control of the fuel control system of FIG. 1.
Figure 2B:
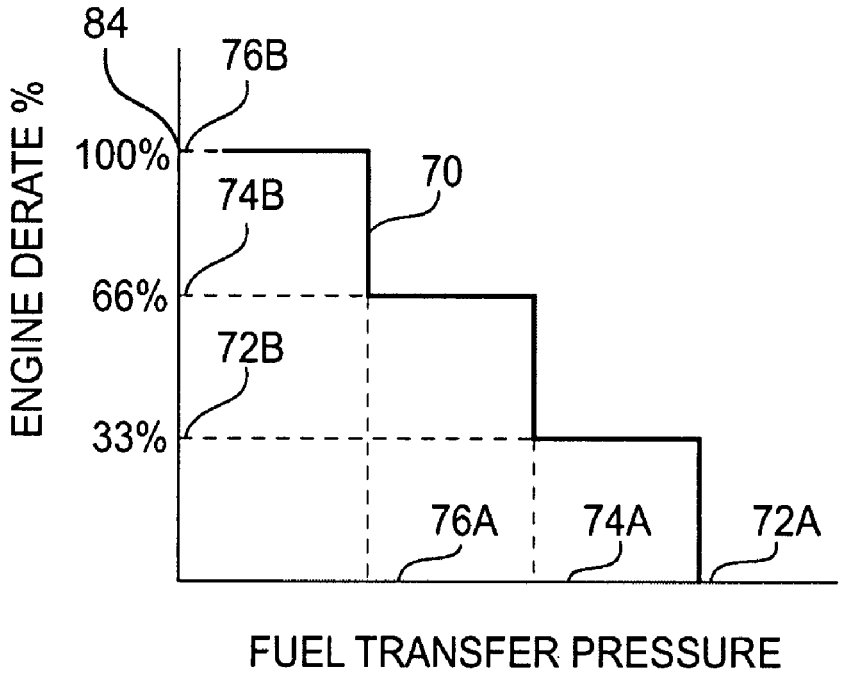
Figure 2C:
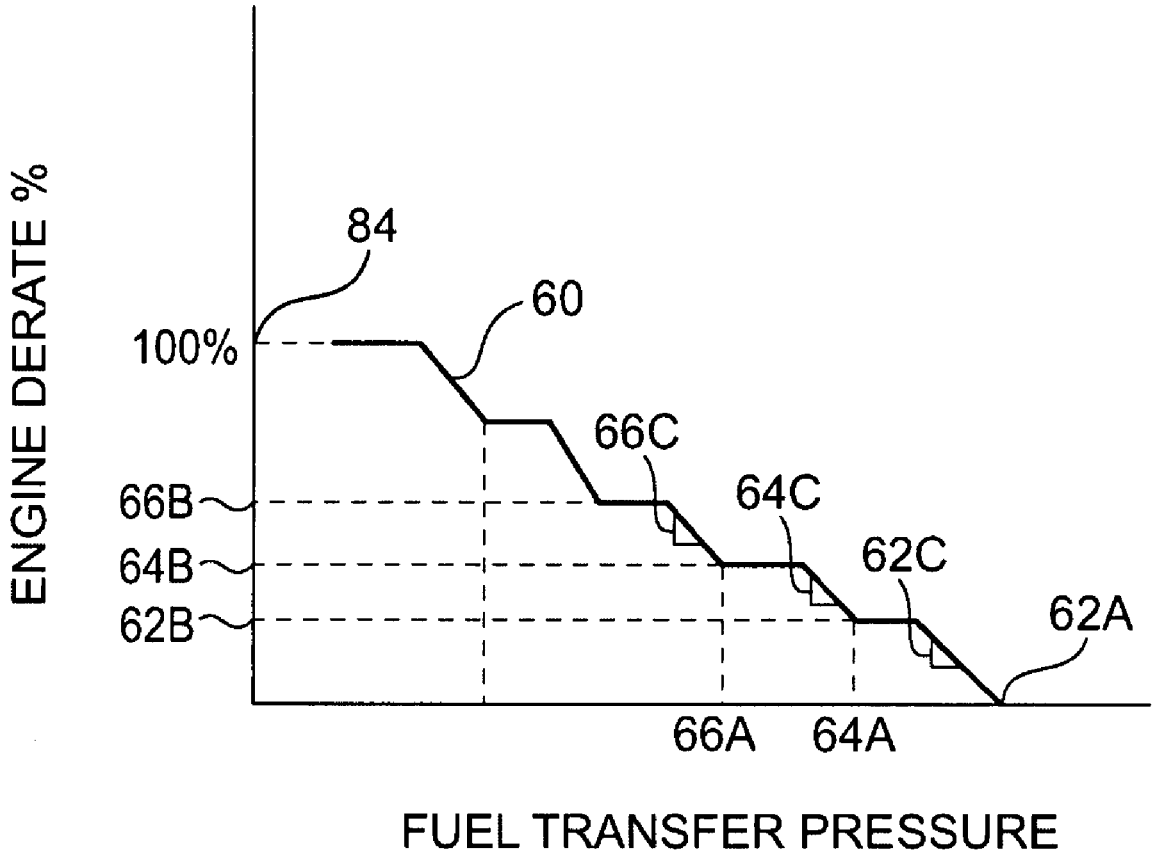

FIGS. 2A-2C illustrate three different embodiments of fuel control systems 10 of the current disclosure. FIG. 2A illustrates a graph 80 of percentage derate applied to engine 100 as a function of fuel transfer pressure according to one embodiment of the disclosed fuel control system. In the embodiment of FIG. 2A, 100% derate 84 may be applied to engine 100 in response to a fuel transfer pressure below a threshold value. The derate may be applied by reducing the quantity of fuel delivered to engine 100. The threshold fuel transfer pressure 82 may depend upon the application and may include a fixed value or a value determined from other sensor readings. For instance, threshold fuel transfer pressure 82 may be a value of fuel transfer pressure at which the torque produced by engine 100 is below the desired value of torque for a predetermined amount of time. As discussed earlier, a 100% derate 84 may reduce the torque produced by engine 100 to the predetermined percentage chosen by ECU 50 (fixed percentage value stored in ECU 50, calculated by ECU 50, or based on a map stored in ECU 50). In an application where the predetermined percentage of torque reduction is chosen to be 80% of the desired torque, applying 100% derate 84 may include decreasing the fuel delivered to engine 100 to reduce the torque produced (by engine 100) to about 20% of the desired value. The engine 100 may continue to operate at this reduced level until engine 100 is shut down. The quantity of fuel delivered to engine 100 may be reduced by reducing the duration of electric pulse applied to fuel injectors 40.

FIG. 2B illustrates another embodiment of fuel control system 10 in which engine 100 is derated incrementally in response to a low fuel transfer pressure. In the embodiment of FIG. 2B, a first derate 72B may be applied when the fuel transfer pressure decreases below a first threshold value 72A. If after the application of first derate 72B, fuel transfer pressure stabilizes (that is, does not decrease further), engine 100 may be latched at the first derate 72B. That is, engine 100 may continue to operate with the first derate 72B applied to it until engine 100 is shut down. If, however, the fuel transfer pressure continues to decrease after the application of first derate 72B, a second derate 74B may be applied to engine 100 when the fuel transfer pressure decreases below a second threshold value 74A. A third derate 76B may further be applied to engine 100 if the fuel transfer pressure decreases below a third threshold value 76A. In some embodiments, a wait time may be incorporated between successive derates. Wait time may be a predetermined amount of time that ECU 50 may wait between each successive derate to allow the system to stabilize. If the fuel transfer pressure stabilizes after a derate is applied, engine 100 be latched at that value of derate. Engine 100 may then continue to operate with that value of derate applied to it until engine 100 is shut down and the fault rectified. For instance, if after applying second derate 74B, fuel transfer pressure stabilizes, engine 100 may be latched at the second derate 74B until the fault is rectified.

The first, second, and third derate 72B, 74B, and 76B may add up to 100% derate 84. In some embodiments, 100% derate 84 may correspond to reducing engine torque to the predetermined percentage chosen by ECU 50 (as in the embodiment of FIG. 2A). Although FIG. 2B illustrates derate values (first, second, and third derate 72B, 74B, and 76B) of about 33.3% being applied to engine 100, it is contemplated that other embodiments may include other derate values.

In some embodiments, ECU 50 may determine an incremental derate to apply to engine 100 in response to a low value of fuel transfer pressure. This incremental derate value may be stored in ECU 50 or may be calculated based on other input. For instance, in some embodiments, an incremental 10% derate may be successively applied to engine 100 until fuel transfer pressure stabilizes. Application of the 10% derate may correspond to a reduction of torque produced by engine 100. The total amount of derate applied to engine may progressively increase (and the torque produced by engine will progressively decrease) with the application of each successive incremental derate. If fuel transfer pressure stabilizes after the application of an incremental value of derate, further application of derate is stopped and engine 100 is latched at the last applied derate value. Engine 100 may continue to operate at this value of derate until engine 100 is shut down and the fault rectified. If, however, fuel transfer pressure does not stabilize, application of incremental derate may be continued until engine 100 is shut down.

Although derating engine 100 decreases the torque produced by engine 100, limiting the amount of derate applied to engine 100 until the fuel transfer pressure stabilizes minimizes this torque reduction. Even in applications that may require the application of 100% derate, applying incremental derate values to derate engine 100 may allow torque produced by engine 100 to be reduced gradually. In some applications, gradually reducing engine torque may reduce the impact of the derating to a user.

FIG. 2C illustrates a graph 60 of another embodiment of fuel control system 10 in which engine 100 is derated incrementally until fuel transfer pressure stabilizes. As in the embodiment of FIG. 2B, a first derate 62B, a second derate 64B, and a third derate 66B may be sequentially applied to engine 100 when the fuel transfer pressure drops below a first threshold 62A, a second threshold 64A, and a third threshold 66A respectively, until fuel transfer pressure stabilizes. In the embodiment of FIG. 2C, however, each incremental derate may be gradually applied when the fuel transfer pressure reaches a threshold value. For instance, when fuel transfer pressure reaches first threshold 62A, derate may be gradually applied until engine 100 is derated by first derate 62B. A slope 62C of graph 60 may define the time taken for first derate 62B to be applied. Gradually applying first derate 62B to engine 100 may reduce engine torque during a derate gradually. Although in an application, the reduction in engine torque resulting from the application of an incremental derate (as in the embodiment of FIG. 2B) may not be sudden, gradually applying an engine derate (as in the embodiment of FIG. 2C) may provide for a smaller instantaneous reduction of engine torque. If fuel transfer pressure continues to decrease after the application of first derate 62B, a second derate 64B may be gradually applied to engine 100 when fuel transfer pressure reaches the second threshold 64A. Slope 64C may define the time taken for second derate 64B to be applied to engine 100. Slopes 62C and 64C may be the same or may be different. As in the embodiment of FIG. 2B, engine 100 may be latched at a derate value when appropriate sensors indicate that the fuel transfer pressure stabilizes.

INDUSTRIAL APPLICABILITY

The disclosed fuel control system may be applicable to any engine where it is desirable to derate an engine only to a level necessary for safe and efficient operation of the engine. The fuel control system utilizes feedback from sensors to identify a low fuel transfer pressure which may detrimentally impact engine performance and incrementally derates the engine until the fuel transfer pressure stabilizes. Incrementally derating the engine until the fuel transfer pressure stabilizes enables the engine to continue delivering power at a level at which efficiency of operation is not compromised. The operation of an engine with an embodiment of the disclosed fuel control system will now be described.

A diesel engine 100 (see FIG. 1) may include fuel injectors 40*a*, 40*b*, 40*c*, and 40*d*, each coupled to a cylinder of the engine. These fuel injectors 40 may deliver fuel to a combustion chamber of the cylinder for combustion. Combustion of fuel in the combustion chamber produces power that may be used to do work by engine 100. Work done by engine 100 may include driving a generator or other device coupled to engine 100. ECU 50 of engine 100 may monitor the performance of engine 100 during operation, by receiving feedback from sensors coupled to engine 100. During operation, sensors may indicate a required power to be produced by engine 100. Based on the required power and the pressure of fuel in rail 34, ECU 50 may energize fuel injectors 40 with an electric pulse. Duration of this electric pulse may determine the amount of fuel delivered to engine. In response to the electric pulse, fuel injectors 40 may deliver the required amount of fuel to the cylinders.

Fuel injectors 40 may be supplied with fuel from fuel tank 12 through a fuel control system 10. In fuel control system 10, a low pressure pump 16 may draw fuel from fuel tank 12 through one or more filters to deliver the fuel to high pressure pump 30. High pressure pump 30 may increase the pressure of the fuel to a rail pressure, and deliver the fuel to a common rail 34. Fuel from common rail 34 may be injected into the combustion chambers of the cylinders in response to the electric pulse from ECU 50. Pressure sensors coupled to the upstream side and downstream side of high pressure pump 30 may provide feedback of fuel transfer pressure and rail pressure to ECU 50. A fault upstream of high pressure pump 30 may decrease the fuel transfer pressure, which in turn may decrease rail pressure. Decreased rail pressure may increase an injection time needed to deliver the required amount of fuel to the cylinders. Increased injection times may cause fuel injection to continue well into the power stroke of engine 100, detrimentally affecting fuel efficiency, engine reliability, and exhaust emissions. To prevent excessively long injection times due to low rail pressure, ECU 50 may derate engine 100 based on fuel transfer pressure.

ECU 50 may compare fuel transfer pressure with a threshold pressure stored in ECU 50. If the fuel transfer pressure is above the threshold pressure, no derating may be applied. ECU 50 may then apply the electric pulse, whose duration corresponds to the required amount of fuel, to fuel injectors 30. If the fuel transfer pressure (as indicated by one or more pressure sensors 20, 25) is below the threshold pressure, ECU 50 may incrementally derate engine 100 until fuel transfer pressure stabilizes (see, for example, FIG. 2B). That is, ECU 50 may apply a first derate 72B when fuel transfer pressure reaches 72A, a second derate 74B when fuel transfer pressure reaches 74A, etc. To derate engine 100, ECU 50 may decrease the duration of the pressure pulse applied to fuel injectors 40 to reduce the amount of fuel supplied to the cylinders. For example, to apply 100% derate to an engine 100 (in an application where 100% derate corresponds to 80% reduction in required power), the duration of the pulse applied to fuel injectors 40 may correspond to the quantity of fuel necessary to produce 20% of the requested power.

It will be apparent to those skilled in the art that various modifications and variations can be made to the disclosed engine fuel control system. Other embodiments will be apparent to those skilled in the art from consideration of the specification and practice of the disclosed engine fuel control system. It is intended that the specification and examples be considered as exemplary only, with a true scope being indicated by the following claims and their equivalents.

What is claimed is:

1. A method of controlling a common rail fuel system for an engine comprising:

delivering fuel to a fuel injector fluidly coupled to a common rail, the common rail being fluidly coupled to a fuel tank through a pump;

sending a signal to the fuel injector to deliver a first quantity of fuel to the engine, the first quantity being indicative of a desired power from the engine;

detecting a fuel transfer pressure upstream of the pump; and derating the engine as a function of the detected fuel transfer pressure, wherein the derating includes decreasing the first quantity of fuel, wherein the derating of the engine includes incrementally derating the engine as a function of the detected fuel transfer pressure.

2. The method of claim 1, wherein the derating of the engine is performed when the fuel transfer pressure decreases below a threshold value.

3. The method of claim 1, wherein the derating of the engine includes decreasing the first quantity of fuel based on a map that indicates a percentage of derate as a function of fuel transfer pressure.

4. The method of claim 1, wherein the derating of the engine includes decreasing the first quantity of fuel until the fuel transfer pressure substantially stabilizes.

5. The method of claim 1, wherein the derating of the engine includes derating the engine by a first amount when the fuel transfer pressure decreases below a first threshold, and derating the engine by a second amount greater than the first amount when the fuel transfer pressure decreases below a second threshold.

6. The method of claim 5, wherein derating the engine by the first amount includes decreasing the first quantity of fuel to a second quantity at a predetermined rate and derating the engine by the second amount includes decreasing the second quantity of fuel to a third quantity at a predetermined rate.

7. The method of claim 1, wherein the derating of the engine includes successively applying an incremental amount of derate on the engine until the fuel transfer pressure substantially stabilizes.

8. The method of claim 7, further including latching the engine, wherein the latching includes operating the engine in a derated condition until the engine is shut down.

9. The method of claim 1, further including shutting the engine down when the detected fuel transfer pressure decreases below a predetermined value.

10. A method of derating an engine, comprising:

delivering fuel to the engine using a common rail fuel system, the common rail fuel system including at least a pump, a common rail, and a fuel injector fluidly coupled in series to deliver the fuel to the engine;

controlling an amount of fuel delivered to the engine based on feedback, the feedback including a desired torque of the engine and a fuel transfer pressure of the fuel system, the desired torque being a measure of a power output desired from the engine, and the fuel transfer pressure being indicative of a pressure of the fuel upstream of the pump; and derating the engine in response to a reduction in the fuel transfer pressure, the derating including reducing the amount of fuel delivered to the engine to reduce a power produced by the engine to below the desired power, wherein derating the engine includes incrementally derating the engine until the fuel transfer pressure stabilizes.

11. The method of claim 10, further including latching the engine, wherein the latching includes operating the engine in a derated condition until the engine is shut down.

12. A method of claim 10, wherein the derating of the engine includes derating the engine by a first amount when the fuel transfer pressure decreases below a first threshold and further derating the engine by a second amount greater than the first amount when the fuel transfer pressure decreases below a second threshold.

13. A method of claim 12, further including waiting a predetermined amount of time between the derating of the engine by the first amount and the derating of the engine by the second amount.

14. The method of claim 10, wherein the derating of the engine includes derating the engine based on a map, the map indicating an amount of derate to be applied at least as a function of the fuel transfer pressure.

15. The method of claim 10, wherein using the control system includes energizing the fuel injector using an electric pulse, a characteristic of the electric pulse being indicative of the amount of fuel delivered to the engine by the fuel injector.

16. The method of claim 10, further including shutting the engine down when the fuel transfer pressure decreases below a predetermined value.

17. A method of operating an engine:

combusting a fuel in a combustion chamber of the engine to produce power;

injecting fuel into the combustion chamber using a fuel injector;

directing fuel to the fuel injector through a common rail using a common rail fuel system, the common rail fuel system including a pump delivering pressurized fuel to the rail;

controlling a timing and quantity of the injected fuel using a control system;

detecting a fuel transfer pressure of the fuel upstream of the pump;

decreasing the quantity of injected fuel by an amount in response to a decrease in fuel transfer pressure to a first threshold pressure; and further decreasing the quantity of injected fuel by an amount in response to a further decrease in fuel transfer pressure from the first threshold pressure to a second threshold pressure.

18. The method of claim 17, wherein the decreasing and the further decreasing of the quantity of injected fuel are continued until the fuel transfer pressure substantially stabilizes.

* * * * *